United States Patent [19]

Thompson-Russell

[11] 4,254,300

[45] Mar. 3, 1981

[54] ELECTRIC LAMP

[75] Inventor: Kathryn C. Thompson-Russell, Eindhoven, Netherlands

[73] Assignee: U.S. Philips Corporation, New York, N.Y.

[21] Appl. No.: 90,364

[22] Filed: Nov. 1, 1979

[30] Foreign Application Priority Data

Nov. 29, 1978 [NL] Netherlands ..... 7811684

[51] Int. Cl.[3] ..... H01K 1/38

[52] U.S. Cl. ..... 174/50.64; 65/59 R; 313/331

[58] Field of Search ..... 174/50.64, 50.61, 152 GM; 65/59 R, 59 A; 313/317, 318, 331

[56] References Cited

U.S. PATENT DOCUMENTS

| | | | |
|---|---|---|---|
| 3,211,826 | 10/1956 | Holcomb et al. | 174/50.64 |
| 4,110,657 | 8/1978 | Sobieski | 174/50.64 |

FOREIGN PATENT DOCUMENTS 1527568 10/1978 United Kingdom .

*Primary Examiner*—B. A. Reynolds
*Assistant Examiner*—D. A. Tone
*Attorney, Agent, or Firm*—Robert S. Smith

[57] ABSTRACT

In electric lamps having a lamp envelope (20) of a type of glass containing at least 95% by weight of $SiO_2$, the current leadthrough conductors (22, 23) usually consist of molybdenum foils to which internal (26, 27) and external (24, 25) current conductors are welded.

After welding and upon making the pinch seal (21) of the lamp vessel (20), fracture frequently occurs in the molybdenum foils (22, 23).

Molybdenum foils (22, 23) in which yttrium oxide particles are dispersed in a quantity of $\frac{1}{4}$–1% of the molybdenum weight, have proved to be considerably stronger than similar thickness molybdenum foils containing no yttrium oxide.

1 Claim, 2 Drawing Figures

ELECTRIC LAMP

The invention relates to an electric lamp having a glass lamp envelope with a pinch seal in which a molybdenum foil is incorporated as a current lead-through conductor, an external current conductor being welded to one end of said foil and an internal current conductor to an electric element accommodated inside the lamp envelope being welded to the other end.

Lamps of the type described above are known from United Kingdom Pat. No. 1,527,568.

In lamps having a lamp envelope of a type of glass containing at least 95% by weight of $SiO_2$, a molybdenum foil is frequently used as a current lead-through conductor. In spite of the considerably different coefficients of thermal expansion of the glass (approximately $10\times10^{-7}$ per deg. C.) and of molybdenum ($54\times10^{-7}$ per deg. C.) lamps having vacuum-tight pinch seals are nevertheless obtained. This is due to the ductility of molybdenum, to the shape of the foil, the knife edges of the foil extending in the longitudinal direction of the pinch, and to the small thickness of the foil, which is a few tens of μm.

Current conductors which are much thicker than the foil, namely a few hundred μm thick are welded to the foil. Moreover, at least the internal current conductor in most cases consists of tungsten which has a much higher melting point than molybdenum and therefore requires a very high welding temperature. After making the weld between te foil and the internal and external current conductors, fracture of the foil frequently occurs near a welded joint on the foil when handling the assembly. A more serious feature of this construction is that upon making pinch seals, fracture occurs in the foil. This results in nearly completed lamps being rejected.

It is the object of the invention to provide an electric lamp having a mechanically stronger current lead-through conductor.

According to the invention, this object is achieved in an electric lamp of the kind mentioned in the opening paragraph in that yttrium oxide particles are dispersed in the molybdenum foil in a quantity of ¼–1% by weight of the molybdenum.

It has surprisingly been found that these small quantities of yttrium oxide considerably increase the strength of the foil both before and after welding operations have been performed, as well as the force which has to be exerted on a weld to break it. Before being pinched in the lamp envelope, the foil according to the invention with the current conductors welded thereto may be heated, if desired, in a reducing atmosphere, up to temperatures of approximately 1300° C. without the advantages of the foil according to the invention being lost.

As is usual in lamps having molybdenum foils in pinch seals, the thickness of molybdenum foils which are used in lamps according to the invention depends on the kind of lamp, and is between approximately 30 and approximately 80 μm. In order to avoid the existence of a capillary passage on either side of the foil in the longitudinal direction of the pinch seal, the molybdenum foil, as is usual in the art, is etched so that knife edges are formed so that the glass of the pinch readily embraces the foil.

It is to be noted that incandescent lamps having a filament of tungsten or molybdenum containing 5 to 10% by weight of a metal oxide, for example yttrium oxide, are known from French Pat. No. 433,131. However, the type of molybdenum of which said filament may consist is not suitable for being processed to and being used as a foil material for a current leadthrough conductor: when the content of yttrium oxide increases, the rollability of molybdenum decreases and the specific electrical resistance increases.

In the molybdenum foil which is used in accordance with the invention, at least 99% of the yttrium oxide particles have diameters of less than 2 μm.

The molybdenum material may be made by soaking molybdenum powder in a solution of a yttrium salt, for example yttrium nitrate. The mixture is then evaporated to dryness while stirring and is then heated in a hydrogen atmosphere. The resulting powder is then compressed into rods and sintered, after which the rods are rolled into foils.

Two embodiments of lamps according to the invention will now be described with reference to the Examples and the drawing, in which.

EXAMPLES

Figure 1:
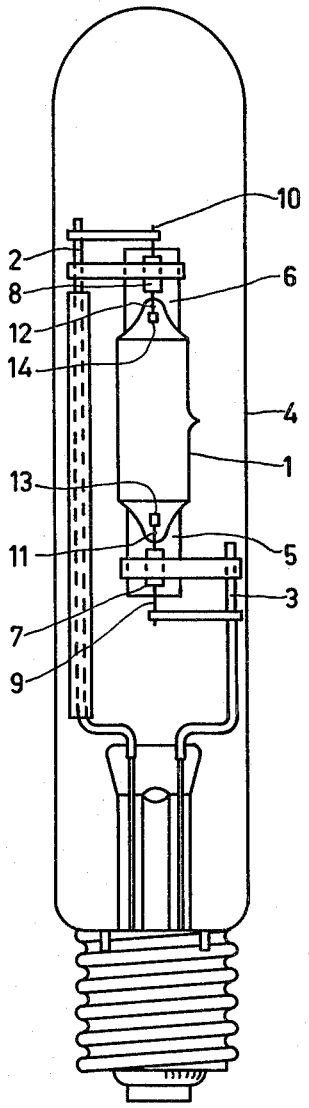
FIG. 1 is a schematic side elevation of a discharge lamp.

In FIG. 1, a quartz glass lamp vessel 1 of a high pressure mercury discharge lamp is disposed between current conductors 2 and 3 in an outer envelope 4. The lamp vessel 1 has two pinch seals 5 and 6 each comprising an yttrium oxide-containing molybdenum foil 7 and 8, respectively, as current lead-through conductors, to which external current conductors 9 and 10, respectively, and internal current conductors 11 and 12, respectively, are welded. The internal current conductors 11, 12 consist of tungsten and extend to a pair of electrodes 13, 14. The external current conductors 9 and 10 consist of molybdenum.

Figure 2:
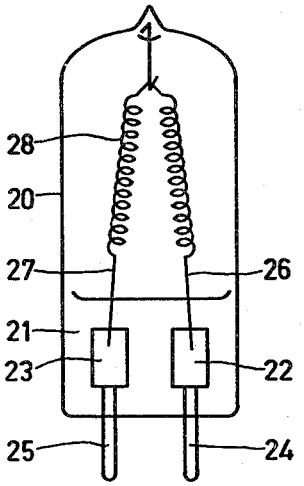
FIG. 2 is a schematic side elevation of an incandescent lamp.

In FIG. 2, reference numeral 20 denotes a quartz glass lamp envelope of a halogen incandescent lamp. It comprises a pinch seal 21 in which yttrium oxide-containing molybdenum foils 22 and 23 are incorporated. Molybdenum external current conductors 24 and 25, respectively, and tungsten internal current conductors 26 and 27, respectively, are welded to the foils 22, 23. A tungsten filament 28 is accommodated in the lamp envelope 20.

A 0.7 mm diameter tungsten wire was welded to a 30 μm thick molybdenum foil, and the limbs of a U-shaped bent Mo wire of 0.5 mm thickness were welded electrically to the other end of the molybdenum foil. The welding time was 20 ms, the welding force 15 N, the welding current 580–590 A. The tensile strength of the welds in the longitudinal direction of the foil and the wire were tested on an apparatus having a measuring range up to 20 N. The measurements were carried out with molybdenum foils containing 0, ¼, ½and 1% by weight of $Y_2O_3$ expressed in terms of the weight of molybdenum. Average values of 500 measurements are recorded in the following Table.

TABLE

| No. | $Y_2O_3$ content of foil (% by weight with respect to Mo | tensile strength (N) weld U-wire | tensile strength (N) weld straight wire |
|---|---|---|---|
| A | 0 | 13.6 | 10.3 |
| 1 | ¼ | >17.6 | >17.9 |
| 2 | ½ | >16.8 | >15.9 |

TABLE-continued

| No. | $Y_2O_3$ content of foil (% by weight with respect to Mo | tensile strength (N) weld U-wire | tensile strength (N) weld straight wire |
|---|---|---|---|
| 3 | 1 | >19.2 | >19 |

After welding, such current conductors were reduced in hydrogen at 1300° C. and were then pinched in quartz glass. The conductors with Mo foils without yttrium oxide gave a reject percentage of 0.9% during making the pinch seal as a result of fracture, the reject percentage in the conductors with ¼, ½ and 1% by weight of yttrium oxide was 0.1%. f The yttrium oxide-containing molybdenum material was obtained by soaking 100 kg of molybdenum powder in a solution of 250, 500 and 1000 g, respectively, of $Y_2O_3$ in nitric acid. The mixture was evaporated to dryness while stirring, and then the dry powder was heated in a hydrogen flow for 30 minutes at 650° C. and then for 120 minutes at 950° C. The mixture was sieved after which the sieved fraction having a particle size between 0.69 and 2.67 μm was compressed to form rods having a density of 5.4 $gcm^{-3}$. These rods were then sintered at 1980° C. The sintered rods were rolled into foils.

What is claimed is:

1. An electric lamp having a glass lamp envelope with a pinch seal in which a molybdenum foil is incorporated as a current lead-through conductor, an external current conductor being welded to one end of the molybdenum foil and an internal conductor to an electric element accommodated inside the lamp envelope being welded to the other end of the molybdenum foil characterized in that yttrium oxide particles are dispersed in the molybdenum foil in a quantity of from ¼ to 1% of the molybdenum weight.

* * * * *